US007046135B2

(12) United States Patent
Blanpain

(10) Patent No.: US 7,046,135 B2
(45) Date of Patent: May 16, 2006

(54) OPERATING METHOD FOR A COMMAND TRANSMITTER

(75) Inventor: Yves Blanpain, Seynod (FR)

(73) Assignee: SOMFY SAS, Cluses (FR)

( * ) Notice: Subject to any disclaimer, the term of this patent is extended or adjusted under 35 U.S.C. 154(b) by 123 days.

(21) Appl. No.: 10/818,733

(22) Filed: Apr. 6, 2004

(65) Prior Publication Data

US 2004/0249477 A1 Dec. 9, 2004

(30) Foreign Application Priority Data

Apr. 15, 2003 (FR) ..... 03 04684

(51) Int. Cl.
*G08B 1/08* (2006.01)

(52) U.S. Cl. ..... 340/539.1; 340/5.1; 340/5.5; 340/5.51

(58) Field of Classification Search ..... 340/5.1, 340/5.5, 5.51, 539.1
See application file for complete search history.

(56) References Cited

U.S. PATENT DOCUMENTS 5,400,246 A * 3/1995 Wilson et al. ..... 700/17

FOREIGN PATENT DOCUMENTS

| | | | |
|---|---|---|---|
| DE | 3927838 | A1 | 2/1991 |
| EP | 0 320 439 | A2 | 12/1988 |
| EP | 1 014 326 | A1 | 12/1999 |

* cited by examiner

*Primary Examiner*—Daryl C Pope
(74) *Attorney, Agent, or Firm*—Frommer Lawrence & Haug LLP; Ronald R. Santucci

(57) ABSTRACT

The operating method for a command transmitter intended for the remote control of electrical equipments providing comfort and/or safety in a building is characterized in that it comprises at least:

a) a first mode in which an action on one or more keys of the control interface gives rise to the transmission of a control signal associated with this action and b) a second mode in which an action on this key or these keys of the control interface gives rise to the display of information relating to the controlled equipment or equipments and/or the command transmitter on the information interface and does not give rise to the transmission of the control signal associated, in the first mode, with this action, a locking means ensuring at least the change from the first mode to the second mode.

10 Claims, 3 Drawing Sheets

OPERATING METHOD FOR A COMMAND TRANSMITTER

RELATED APPLICATIONS

The present invention claims priority from French application no. 0304684 filed on Apr. 15, 2003.

FIELD OF THE INVENTION

The invention relates to an operating method for a command transmitter intended for the remote control of electrical equipments providing comfort and/or safety in a building, the command transmitter comprising a control interface, an information interface, signal transmitting means, signal receiving means and a means of locking the control interface. It furthermore relates to a command transmitter operating according to such a method.

PRIOR ART

Traditionally, command transmitters comprise control keys. Pressing one of these keys results in the transmission of a control command associated with the key to a paired command receiver controlling an electrical equipment.

Remote command transmitters of the mobile type are often carried in pockets or bags, or are handled with few precautions. Random control triggering can therefore occur.

This problem is generally solved by a mechanical locking device such as a protective cover, hardness of pressing the keys or a recessed shape of the keys or by an electronic device. For example, the patent U.S. Pat. No. 4,670,747, the content of which is incorporated by reference, describes a device provided with a digital keyboard that can be locked by pressing a locking key.

Furthermore, remote control devices of the present time are often provided with means of displaying the state or status of the control device. Such a device is known, for example, from the application EP 1 172 937, the content of which is incorporated by reference. It describes a command transmitter comprising display means, which can allow the user to display information relating to the operational status of the command transmitter, and a keyboard. The keyboard can be used to enter a password to activate the command transmitter. A special key on the control keyboard activates the status interrogation function.

Similarly, the patent application EP 1 014 326, the content of which is incorporated by reference, describes a remote control device, of the electronic key type, for a vehicle, comprising a transceiver and a display (acoustic or visual) of the information returned regarding the status of the controlled object.

FIG. 1 is a diagrammatic representation of the actions and reactions of a known remote control command transmitter of the prior art. This command transmitter controls an electrical equipment.

In a conventional way, when a user carries out an action, represented by the arrow 40, on the command transmitter, such as pressing one or more special keys on the keyboard, the command transmitter prepares a control command in box 41 and sends it to the equipment by means of a communication represented by the arrow 42. The equipment then receives this command and executes it in box 43.

Mobile command transmitters can also be provided with status interrogation functions. This is a matter of interrogation, by means of bidirectional communication, regarding the status of the associated equipment. The command transmitters and the equipments therefore have signal transmitting and receiving functions.

This function is generally implemented by special ergonomics, of the double press on a key or a combination of presses type, or by pressing a separate button. This action, represented by the arrow 44 gives rise to the preparation of an interrogation message in box 45 and the sending of this message, represented by the arrow 46. A response to this message is transmitted by the equipment and is represented by the arrow 47. The status of the equipment is then displayed in box 48.

The patent application EP 0 320 439, the content of which is incorporated by reference, describes a remote control device for an equipment of a vehicle. It comprises means of transmitting and receiving signals in a remote control unit and means of transmitting and receiving signals in a vehicle. To allow the sending of a command from the remote control unit to the vehicle, it is necessary to enter a security code which is or is not recognized by the vehicle. The remote control unit also comprises means of informing the user, such as diodes and a loudspeaker. Each key of the remote control unit is associated with a function: pressing a key on the remote control unit gives rise to the transmission of a signal to the vehicle. This signal can be a control signal for a given function, a request for information on the status of the equipments of the vehicle or an alarm activation. These signals are interpreted only if a security code has been transmitted in a time slot preceding or following these signals. In fact, the information return itself is received by the remote control unit only if the security code has been correctly received by the vehicle.

SUMMARY OF THE INVENTION

The purpose of the invention is to provide a method making it possible to overcome the abovementioned problem and to improve the known methods of the prior art. In particular, the invention proposes a method making it possible to prevent random control initiations, in the case of remote command transmitters comprising means of interrogation of the status of the controlled equipment and/or of the command transmitter itself.

The operating method according to the invention is characterized in that it comprises at least:

a) a first mode in which an action on one or more keys of the control interface gives rise to the transmission of a control signal associated with this action and b) a second mode in which an action on this key or these keys of the control interface gives rise to the display of information relating to the controlled equipment or equipments and/or the command transmitter on the information interface and does not give rise to the transmission of the control signal associated, in the first mode, with this action, the locking means ensuring at least the change from the first mode to the second mode.

The locking of the control functions is thus carried out by switching into a different operational mode, in particular the status interrogation mode. This locking consists in deactivating the command transmission of certain controls, without however locking the keyboard which is then used for status interrogation. In this mode, even an involuntary pressing of the keyboard will have no effect on the equipment. On the contrary, at least certain random control commands are excluded. Unlocking renders the keyboard fully active for carrying out a control.

Different implementations of the method are defined by the dependent claims 2 to 8.

The command transmitter according to the invention is defined by the independent claim 9.

The locking means can be mechanical and/or electronic.

BRIEF DESCRIPTION OF THE DRAWINGS

The appended drawing shows, by way of example, an implementation of the method according to the invention.

Figure 1:
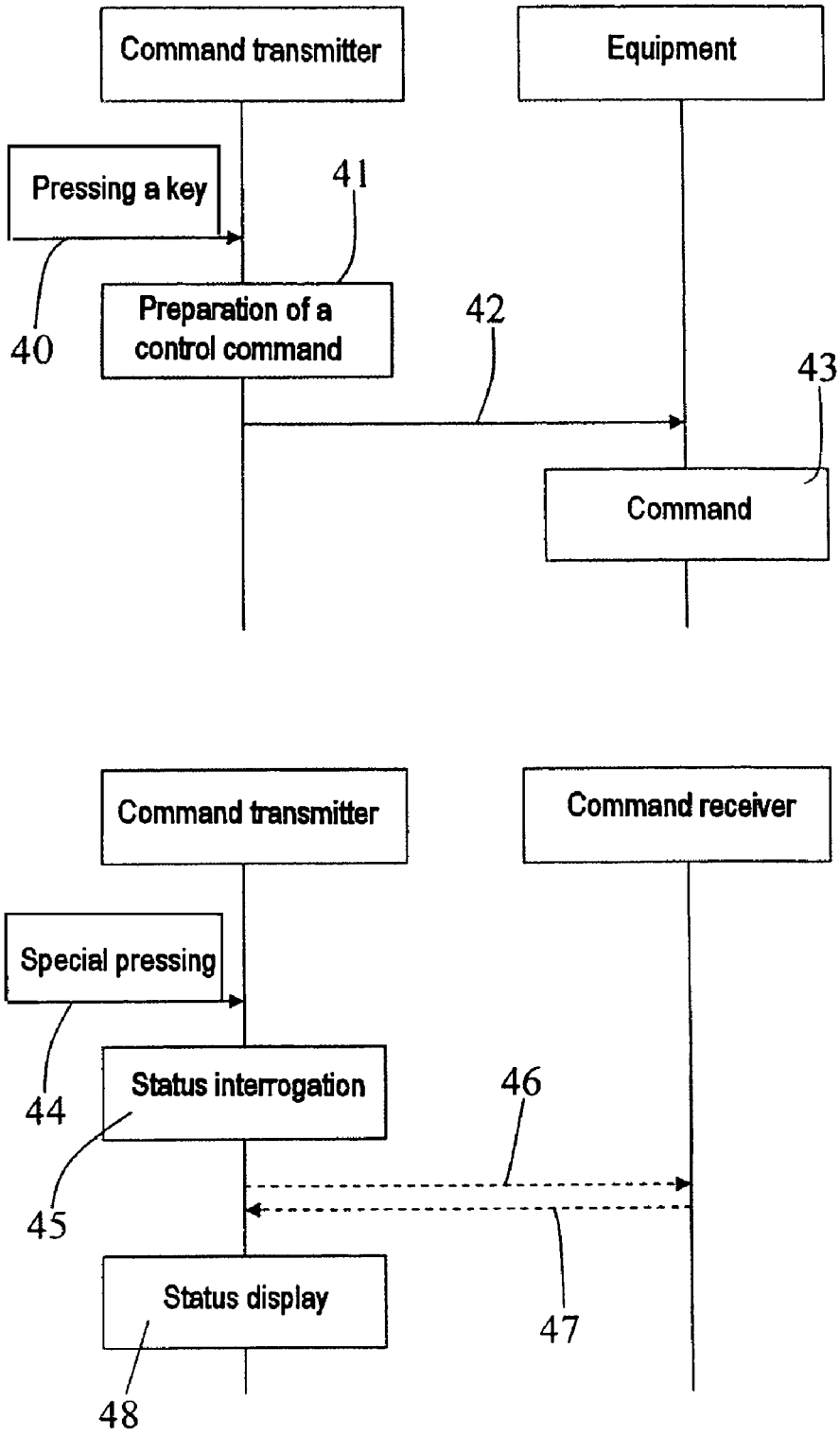
Fig. 1 (Prior art)
FIG. 1 is a flowchart of an operating method of a known command transmitter of the prior art.
Figure 2:
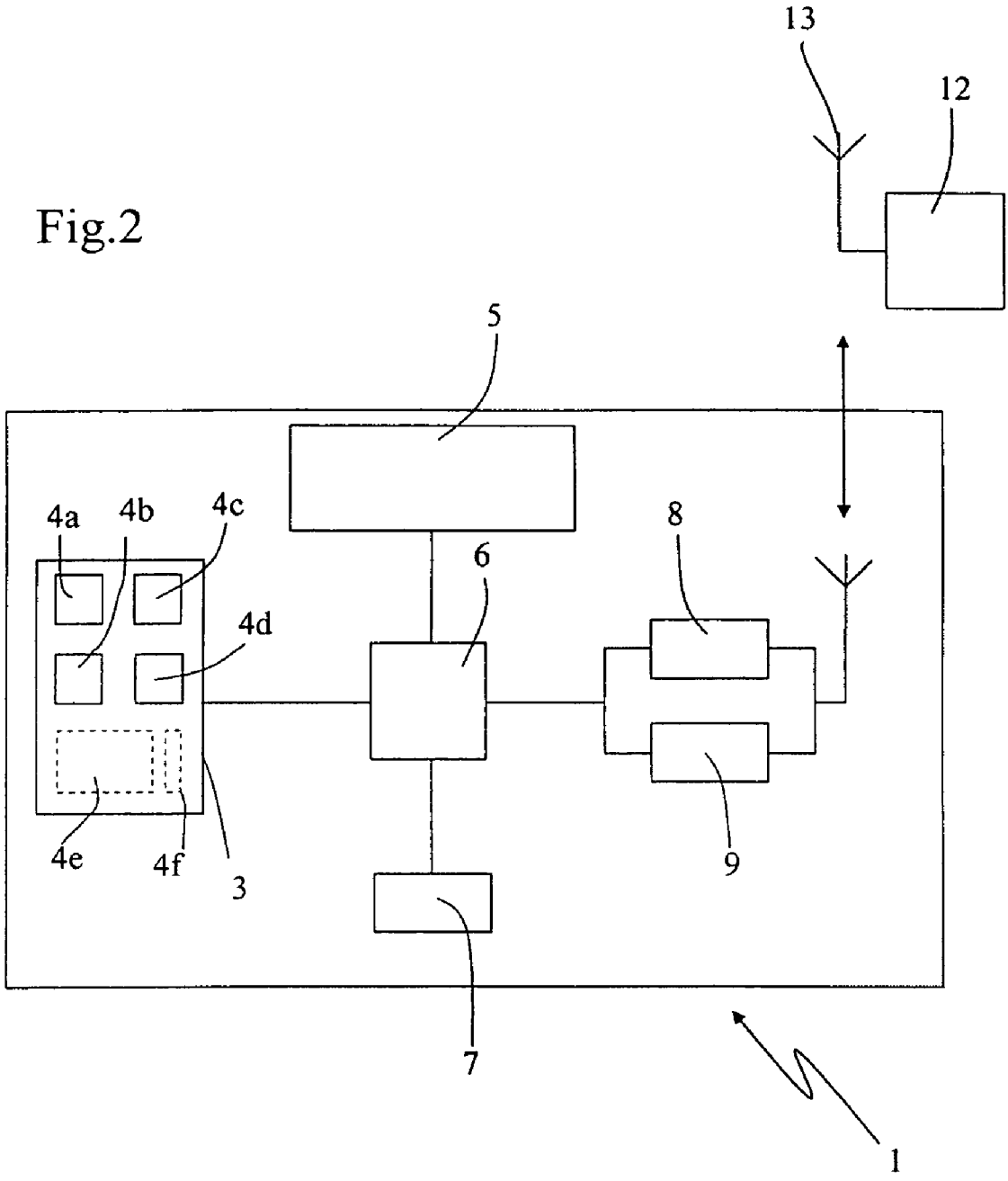
FIG. 2 is a block diagram of a command transmitter according to the invention.

The command transmitter 1 shown in FIG. 2 consists of a casing 2 comprising a keyboard 3 provided with keys 4*a* to 4*f* and an information display device 5. The command transmitter furthermore comprises a processing unit 6, a memory 7, signal transmitting means 8, signal receiving means 9 and a means of locking the keyboard. The command transmitter 1 is intended to control one or more electrical equipments 12 each provided with a command receiver 13 and equipping a building. These equipments can, for example, consist of a garage door, a main door, roller blinds or lighting units. The signal transmitting and receiving means allow the command transmitter to communicate in a bidirectional manner with the command receiver associated with each equipment. Thus, an acknowledgement of reception can be transmitted after each command transmission. The content of this acknowledgement of reception can be indicated to the user by means of the display screen.

This acknowledgement of reception, or confirmation, allows the user to know if the control has been correctly received by the command receiver and/or if the instruction has been executed correctly.

The display device 5 comprises, for example, light emitting diodes. A code based on the colors of the diodes, their flashing frequency or their number of flashes makes it possible to encode the information. It can also be a liquid crystal screen.

The keys 4*a*, 4*b*, 4*c*, 4*d* and 4*e* are control keys. Each control key can be used for the transmission of a unique command, for example for raising or lowering a motorized equipment, or it can correspond to a particular equipment to be controlled. In the latter case, the keys operate sequentially, that is to say that successive pressings allow the transmission of sequences of commands of the "raise", "lower", "stop", etc. type.

In a first operating mode of the transmitter, called the "unlocked" mode, when one of the control keys of the control interface is pressed, the command transmitter transmits a command to the equipment in question.

Other keys can be present on the control interface. There can, for example, be an information key 4*f*. Whatever the operating mode of the command transmitter may be, when this key 4*f* is operated, the command transmitter displays on the screen 5 the status of the controlled equipment or equipments.

Figure 3:
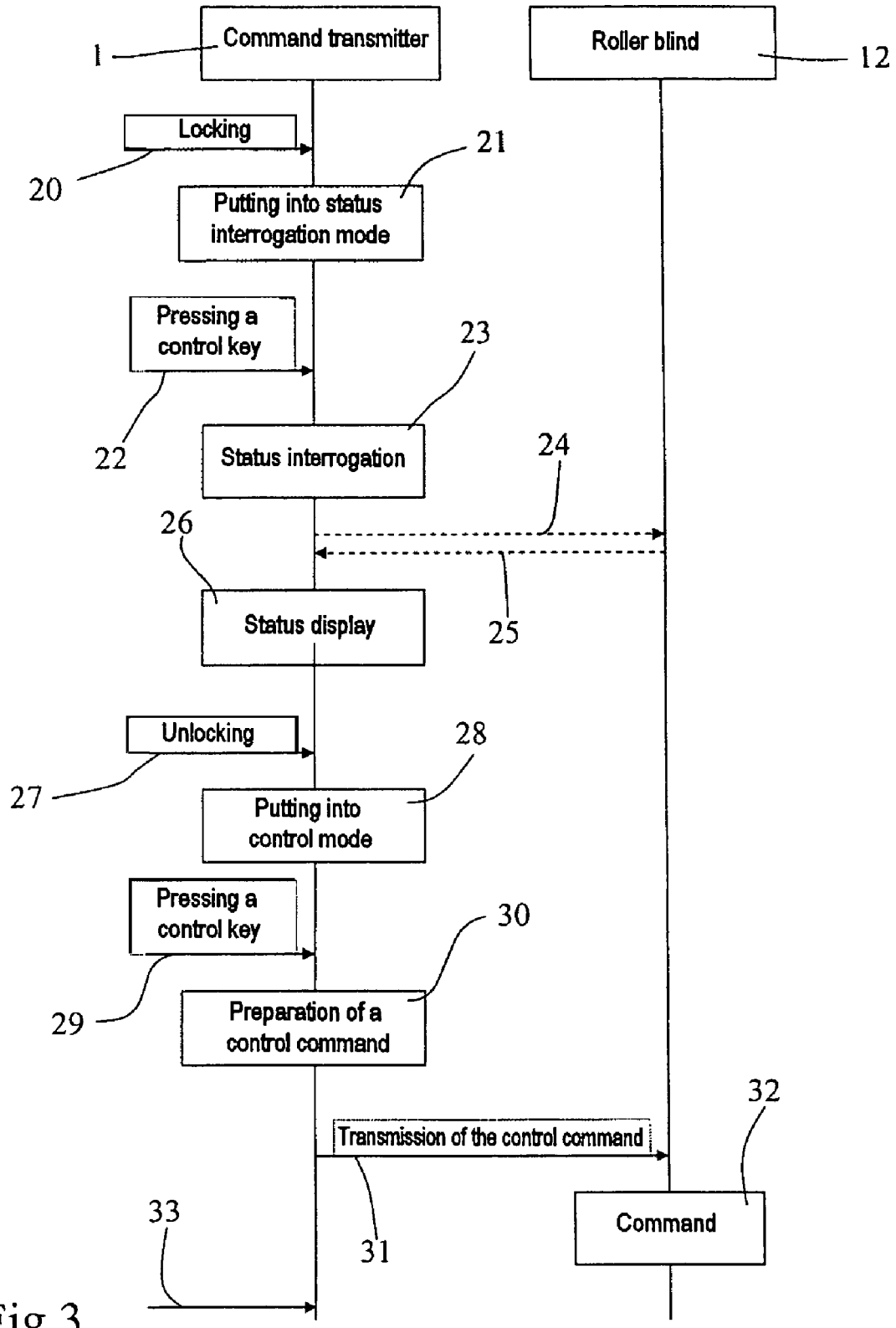
FIG. 3 is a flowchart of an operating method of a command transmitter.

FIG. 3 is a flowchart illustrating the operation of the command transmitter according to the invention.

An action, represented by the arrow 20, for example using special ergonomics on the keys of the keyboard, of the sequence of pressings, successive pressings or prolonged pressings type, the operation of a separate button or the end of a time delay, makes it possible to switch the command transmitter from the "unlocked" mode into a status interrogation operational mode, called the "locked" mode and represented by box 21. In this mode, some control keys 4*a* to 4*d* no longer make it possible to send the commands to the equipments. A pressing of these keys, represented by the arrow 22, is interpreted in box 23 by the command transmitter as a request for information on the status of the equipment or equipments, for example the garage door. The command transmitter then transmits an interrogation message, represented by the arrow 24, to the garage door. The garage door returns a response regarding its status (open, closed, presence of an obstacle, etc.), represented by the arrow 25. The command transmitter then displays this status in box 26.

Thus, random pressings on these control keys of the keyboard, for example in a bag or during careless handling, do not result in any unwanted command but only in a status interrogation. This configuration also makes it possible to limit the number of keys and the use of functions, which reduces manufacturing costs.

Certain control keys can remain active in the so-called "locked" mode. This is the case, for example, of the control key 4*e* which makes it possible, in order to comply with safety measures, to transmit equipment stop commands even when the transmitter is in the "locked" mode.

Following an action represented by the arrow 27, for example special ergonomics of the sequence of pressings, successive pressings or prolonged pressings type, on the keys of the keyboard or the operation of a separate button, the command transmitter switches from the status interrogation mode, called the "locked" mode into the control mode, called the "unlocked" mode and represented by box 28. In this mode, pressing one of the control keys causes the preparation of a control command represented by box 30 and the transmission of this control command represented by the arrow 31. Once received by the receiver linked with the equipment, the command is executed in box 32.

The command transmitter again switches into the "locked" mode when a time delay elapses or when there is a specific action represented by the arrow 33, equivalent to the action represented by the arrow 20.

The invention claimed is:

1. An operating method for a command transmitter (1) intended for the remote control of electrical equipments (12) providing comfort and/or safety in a building, the command transmitter comprising a control interface (3), an information interface (5), signal transmitting means (8), signal receiving means (9) and a means of locking the control interface, which method comprises at least:

a) a first mode in which an action on one or more keys (4*a*–4*d*) of the control interface gives rise to the transmission of a control signal associated with this action and b) a second mode in which an action on this key or these keys (4*a*–4*d*) of the control interface gives rise to the display of information relating to the controlled equipment or equipments and/or the command transmitter on the information interface and does not give rise to the transmission of the control signal associated, in the first mode, with this action, the locking means ensuring at least the change from the first mode to the second mode.

2. The operating method as claimed in claim 1, wherein the display of information regarding the equipment or equipments (12) and/or the command transmitter (1) is also available, at least partially, in the first mode.

3. The operating method as claimed in claim 1, wherein, in the first mode, an action on the said key or keys (4*a*–4*d*) causes the following steps: generation and transmission of a control message by the command transmitter (1), after reception of this message by a command receiver (13) linked with an equipment (12) and then generation and transmission by the command receiver (13) of a confirmation, reception of this confirmation by the command transmitter (1), display of this confirmation on the information interface (5).

4. The operating method as claimed in claim 1, wherein, in the second mode, an action on the said key or keys (4*a*–4*d*) causes the following steps: generation and transmission of an interrogation message by the command transmitter (1), after reception of this message by a command receiver (13) linked with an equipment (12) and then generation and transmission by the command receiver (13) of a confirmation, reception of this confirmation by the command transmitter (1), display of this confirmation in the information interface (5).

5. The operating method as claimed in claim 1, wherein the information relates to the status of the controlled equipment or equipments (12) and/or the status of the command transmitter (1).

6. The operating method as claimed in claim 1, wherein the locking means comprises a special sequence of actions on the control interface (3).

7. The operating method as claimed in claim 1, wherein the locking means comprises a time delay.

8. The operating method as claimed in claim 1, wherein the change from the second mode to the first mode is ensured by a special sequence of actions on the control interface (3).

9. A command transmitter (1) comprising a processing unit (6), a memory (7), signal transmitting means (8), signal receiving means (9), a control interface (3) and a user information interface (5), which transmitter comprises:

a) a first mode in which an action on one or more keys (4*a*–4*d*) of the control interface gives rise to the transmission of a control signal associated with this action, b) a second mode in which an action on this key or these keys (4*a*–4*d*) of the control interface gives rise to the display of information relating to the controlled equipment or equipments and/or the command transmitter on the information interface and does not give rise to the transmission of the control signal associated, in the first mode, with this action; and means of locking the control interface, the locking means ensuring at least the change from the first mode to the second mode.

10. The command transmitter as claimed in claim 9, wherein the locking means is mechanical and/or electronic.

* * * * *